US010537187B2

(12) United States Patent
Wind, III

(10) Patent No.: US 10,537,187 B2
(45) Date of Patent: Jan. 21, 2020

(54) AUGMENTED REFRIGERATED DISPLAY UNIT

(71) Applicant: Walmart Apollo, LLC, Bentonville, AR (US)

(72) Inventor: Anthony G. Wind, III, Gravette, AR (US)

(73) Assignee: Walmart Apollo, LLC, Bentonville, AR (US)

( * ) Notice: Subject to any disclaimer, the term of this patent is extended or adjusted under 35 U.S.C. 154(b) by 97 days.

(21) Appl. No.: 15/280,511

(22) Filed: Sep. 29, 2016

(65) Prior Publication Data

US 2017/0095092 A1 Apr. 6, 2017

Related U.S. Application Data

(60) Provisional application No. 62/236,505, filed on Oct. 2, 2015.

(51) Int. Cl.

| | |
|---|---|
| ***H02K 7/14*** | (2006.01) |
| ***A47F 3/04*** | (2006.01) |
| ***F25D 23/02*** | (2006.01) |
| ***F25D 29/00*** | (2006.01) |

(52) U.S. Cl.

CPC ..... *A47F 3/043* (2013.01); *F25D 23/028* (2013.01); *F25D 29/008* (2013.01); *F25D 2700/02* (2013.01)

(58) Field of Classification Search

CPC ..... A47F 3/043; F25D 23/028; F25D 29/008; F25D 2700/02

USPC ..... 318/3

See application file for complete search history.

(56) References Cited

U.S. PATENT DOCUMENTS 4,387,578 A * 6/1983 Paddock ..... F25D 29/00 165/11.1
4,490,986 A * 1/1985 Paddock ..... F25D 29/00 340/527
4,566,285 A * 1/1986 Tershak ..... F25D 29/008 340/522

(Continued)

FOREIGN PATENT DOCUMENTS

WO 2016036213 A1 3/2016

OTHER PUBLICATIONS

Combined Search and Examination Report from related Great Britain patent application No. GB1616684.5 dated Mar. 6, 2017.

*Primary Examiner* — Bickey Dhakal
*Assistant Examiner* — Gabriel Agared
(74) *Attorney, Agent, or Firm* — McCarter & English, LLP; David R. Burns

(57) ABSTRACT

An augmented refrigerated display unit is provided. The refrigerated display unit includes a door being hingedly attached to the refrigerated display unit, an augmentation drive operatively connected to a hinge of the door for applying an assistive force to the door, and an initiation sensor configured to detect an application of a manual force to the door. The augmentation drive applies an assistive opening force to the door in response to detection by the initiation sensor of an application of the manual force to open the door, a holding force in response to a detection of the door reaching an open position, and an assistive closing force to the door in response to a detection of the manual force being applied to close the door.

16 Claims, 5 Drawing Sheets

(56) References Cited

U.S. PATENT DOCUMENTS

| | | | | |
|---|---|---|---|---|
| 6,223,817 | B1 * | 5/2001 | Oden | F25D 29/00 165/232 |
| 6,225,904 | B1 * | 5/2001 | Jaffe | F25D 23/021 340/545.3 |
| 6,401,466 | B1 * | 6/2002 | Olsen | F25D 29/00 62/131 |
| 7,259,359 | B2 | 8/2007 | Davey et al. | |
| 7,377,125 | B2 | 5/2008 | Seiden et al. | |
| 8,217,611 | B2 | 7/2012 | Ennis | |
| 8,668,289 | B2 | 3/2014 | Lee et al. | |
| 8,981,698 | B2 | 3/2015 | Fuhge | |
| 2005/0262868 | A1 | 12/2005 | Jeong et al. | |
| 2008/0036238 | A1 * | 2/2008 | Weeda | B60P 3/20 296/146.1 |
| 2010/0018240 | A1 | 1/2010 | Hecht et al. | |
| 2011/0307098 | A1 * | 12/2011 | Ennis | G10L 15/26 700/275 |
| 2013/0099715 | A1 * | 4/2013 | Fuhge | E05F 15/611 318/484 |
| 2014/0230483 | A1 | 8/2014 | Kempfle | |
| 2014/0265805 | A1 | 9/2014 | Chamberlin | |

* cited by examiner

AUGMENTED REFRIGERATED DISPLAY UNIT

CROSS-REFERENCE TO RELATED PATENT APPLICATIONS

This application claims priority to U.S. Provisional Application No. 62/236,505 filed on Oct. 2, 2015, the content of which is hereby incorporated by reference in its entirety.

FIELD OF INVENTION

The disclosure relates generally to refrigerated display units and more particularly to refrigerated displays having augmented door operation.

BACKGROUND

Conventionally, refrigerated displays include a manually operable door. However, existing refrigerated display units can be energy inefficient or unwieldy. Customers often hold the doors open while browsing contents of the refrigerated display and such displays are susceptible to blockages preventing the door from closing. Furthermore, customers often struggle with removal of larger items from the refrigerated display because the customer must simultaneously hold the door open and retrieve the item.

BRIEF DESCRIPTION OF THE DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Figure 1:
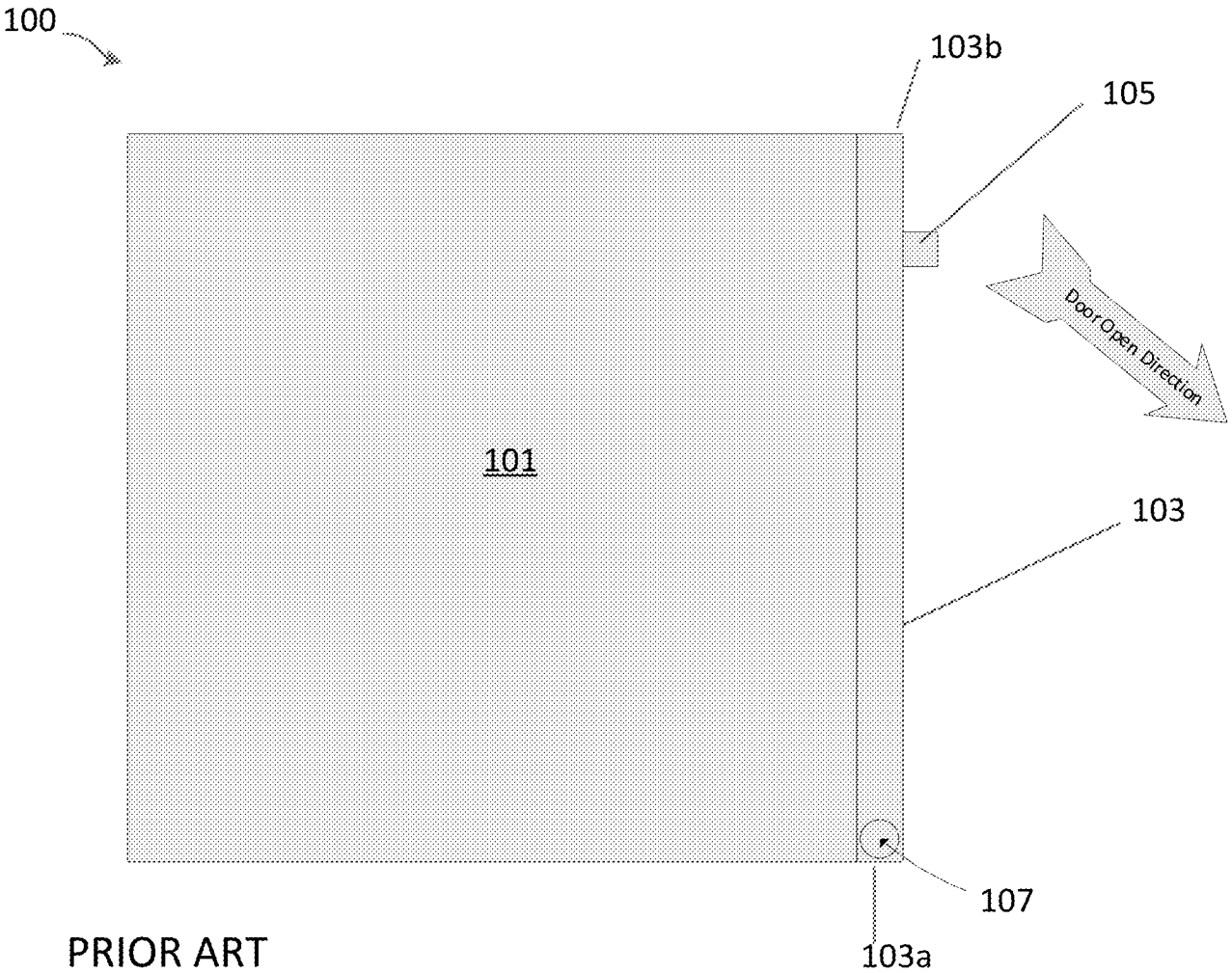
PRIOR ART FIG. 1
FIG. 1 is a top view of a conventional refrigeration unit in accordance with various embodiments.

Referring now to FIG. 1, a conventional refrigerated display unit 100 includes a refrigeration unit 101, a door 103 having a first side 103*a* hingedly attached to the refrigeration unit 101 by a hinge 107. The door 103 is openable at a second side 103*b* thereof and includes a handle 105 mounted thereon for manually opening and closing the door.

Energy efficiencies are introduced in such conventional refrigerated display units 100 when customers hold the door open to browse for products rather than looking through the window of the display unit, when customers open or close the door too slowly, when customers leave items blocking the door of the refrigerated display unit from closing.

Additionally, manual doors often interfere with customers who are trying to extract larger items (e.g., items that require two hands to pick up) from the refrigerated display unit because the customer must hold the door and pick up the item at the same time, requiring awkward and non-ergonomic positioning.

Methods and apparatus are provided herein for an augmented refrigerated display unit for mitigating energy inefficiencies and assisting manual operation of a door of the refrigerated display unit. The example system, in accordance with various embodiments, includes a refrigerated display unit having a hinged door, wherein application of a manual force to the door is detectable by an initiation sensor and an augmentation drive, operatively connected to a hinge of the door, is configured to apply an assistive opening, holding, or closing force to the door in response to detection of the application of the manual force.

Figure 2A:
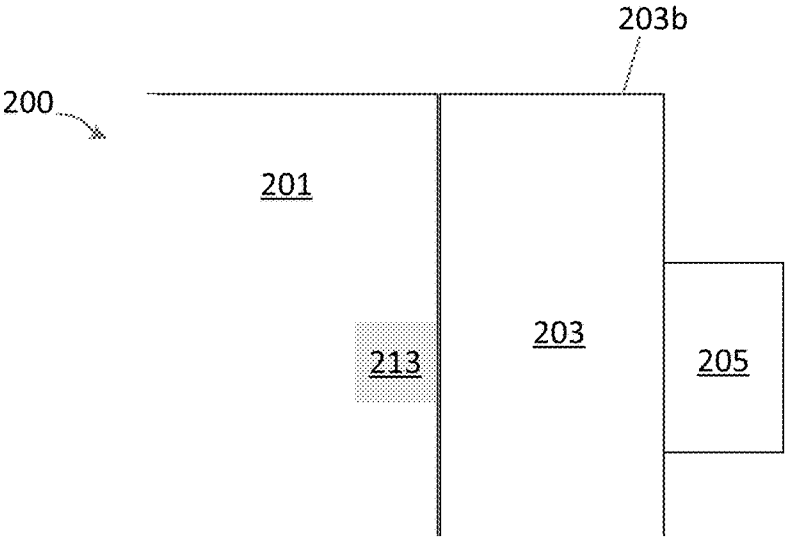
FIG. 2A is a cross-sectional view of an openable side of a door of an augmented refrigeration unit in accordance with various embodiments.
Figure 2B:
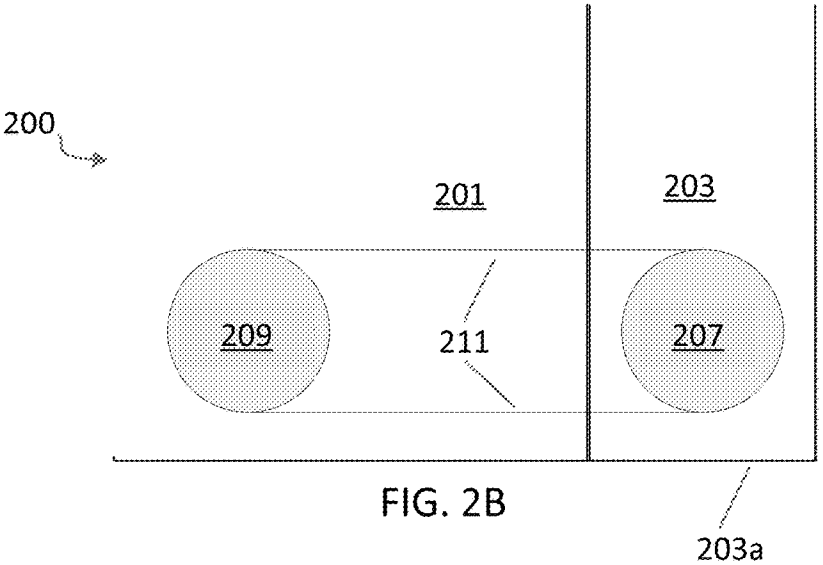
FIG. 2B is a cross-sectional view of a hinged side of a door of an augmented refrigeration unit in accordance with various embodiments.

Referring now to FIGS. 2A and 2B, an augmented refrigerated display unit 200, in accordance with various embodiments, includes a refrigeration unit 201, a door 203 hingedly attached to the refrigeration unit 201 at a first side 203*a* of the door 203. The door 203 is openable at a second side 203*b* thereof. A handle 205 can be mounted on or formed in the door 203, in accordance with various embodiments to permit a user to apply a manual opening or closing force to the door 203. In accordance with various embodiments, an initiation sensor 213 is included for detecting application of the manual force to the door 203 by the user. The refrigerated display unit 200 also includes an augmentation drive 209 operatively connected to the hinge 207 for applying an assistive opening, closing, or holding force to the door 203.

Refrigeration unit 201, in accordance with various embodiments, can include, for example but not limited to, any suitable refrigeration unit known in the art or any other device suitable for keeping a contents of the refrigeration unit 201 at a desired temperature lower than an ambient temperature external to the refrigeration unit 201. Door 203, in accordance with various embodiments can include, for example, any solid door, any screened door, or, most preferably, any display door including a window or other transparent portion therein.

Hinge 207 can include any suitable hinge mechanism including, for example, an extended rod extending through a through-hole formed in the first side 203*a* of the door 203, a combination of an upper rod and a lower rod, each extending into recesses formed in a top and a bottom of the first side 203*a* of the door 203, a combination of an upper rod and a lower rod, each extending outward from the door into a recess formed in upper and lower brackets of the refrigeration unit 201, or any other suitable device for permitting the door 203 to rotate about the hinge 207 between an open position and a closed position of the door 203.

Augmentation drive 209 can, in accordance with various embodiments, include one or more of a DC induction motor, a stepper motor, a servo, or a linear actuator. As shown in FIG. 2B, in accordance with various embodiments, the augmentation drive 209 can be operatively connected to the hinge 207 via a chain drive including sprockets at the augmentation drive 209 and hinge 207 connected by a drive chain 211. Although not shown, in accordance with various embodiments, the augmentation drive 209 can be operatively connected to the hinge, for example, by a direct drive wherein a drive shaft of the augmentation drive 209 is directly connected to the hinge 207. It will be apparent in view of this disclosure that other operative connections between the augmentation drive 209 and the hinge 207 can be used in accordance with various embodiments, including for example, one or more of indirect drives, transmission drives, or rack and pinion drives.

Initiation sensor 213 can be any suitable sensor or combination of two or more sensors, including for example, one or more of a motion detector, a closed switch, a pressure sensor, or a current detector in windings of the augmentation drive 209. Although shown in FIG. 2A as being positioned between the refrigeration unit 201 and the door 203 at the second end 203*b* of the door 203, it will be apparent in view of this disclosure that the initiation sensor 213 can positioned at any suitable location on the refrigerated display unit 200. For example, if the initiation sensor 213 was a pressure sensor, it could be mounted as shown in FIG. 2A, in the handle 205, or at any location along an interior perimeter of the door 203. By contrast, for example, if the initiation sensor was a current detector in the windings for the augmentation drive 209, it can be co-located with the augmentation drive 209.

Figure 4:
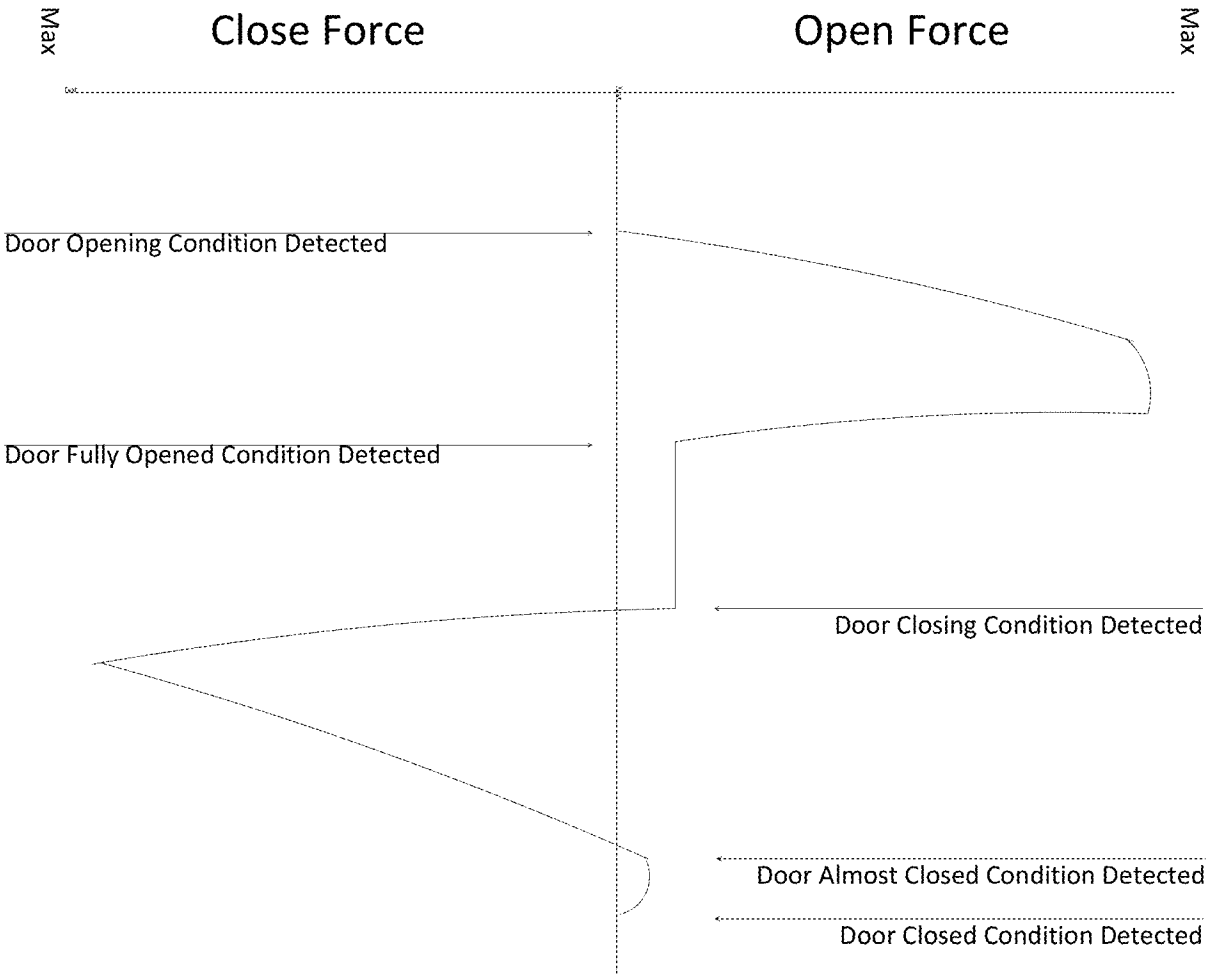
FIG. 4 is a plot of applied force by an augmentation drive over time during operation of an augmented refrigerated display unit in accordance with various embodiments.

In accordance with various embodiments, as shown in FIG. 4, an operation cycle of the augmented refrigerated display unit 200 begins when the initiation sensor 213 detects a manual opening force applied to the door 203. In response to the detection, the augmentation drive 209 applies an assistive opening force to the door 203. Upon detection by the initiation sensor 213 or at least one additional sensor that the door 203 is in an open position, the augmentation drive 209 terminates the assistive opening force and applies a holding force to maintain the open position of the door 203. Upon detection by the initiation sensor 213 or at least one additional sensor of a manual closing force applied to the door 203, the augmentation drive 209 terminates the holding force and applies an assistive closing force to the door 203. In accordance with various embodiments and as shown in FIG. 4, the initiation sensor 213 or at least one additional sensor can further be configured to detect an almost closed or partially closed position of the door 203. Upon detection of the almost or partially closed position of the door, the augmentation drive 209 can terminate the closing force and apply an anti-slam force for preventing the door 203 from slamming and/or bouncing back open. It will be apparent in view of this disclosure that the anti-slam feature is optional and that, in accordance with other embodiments, the closing force can instead be terminated upon detection of a closed position of the door 203.

Figure 3:
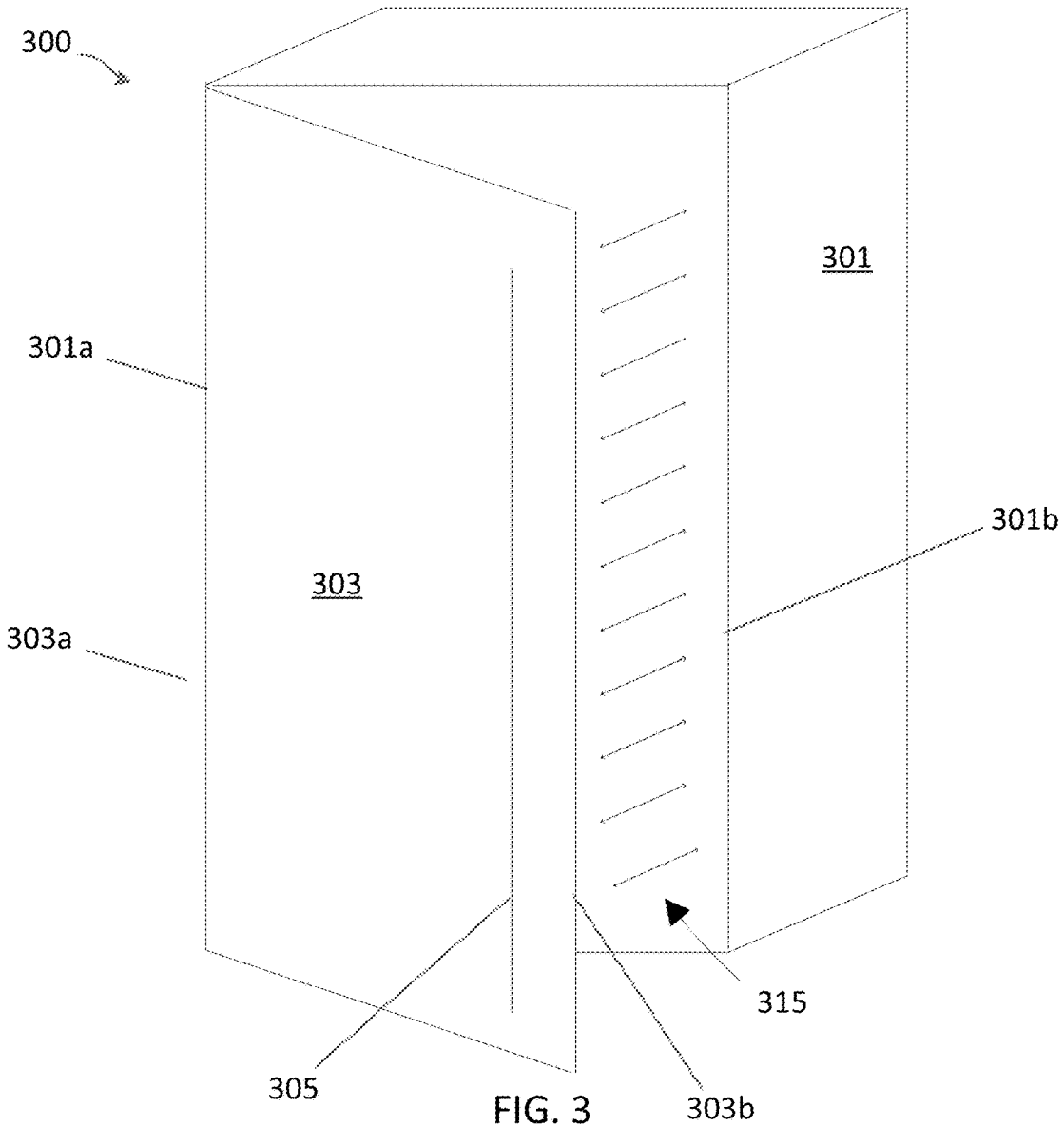
FIG. 3 is a perspective view of an augmented refrigeration unit having a light curtain sensor in accordance with various embodiments.

Referring now to FIG. 3, an augmented refrigerated display unit 300, in accordance with various embodiments, includes a refrigeration unit 301, a door 303 hingedly attached to the refrigeration unit 301 at a first side 303*a* of the door 303. The door 303 is openable at a second side 303*b* thereof. A handle 305 can be mounted on or formed in the door 303, in accordance with various embodiments to permit a user to apply a manual opening or closing force to the door 303. In accordance with various embodiments, an initiation sensor (not shown) is included for detecting application of the manual force to the door 303 by the user. The refrigerated display unit 300 also includes an augmentation drive (not shown) operatively connected to the hinge (not shown) for applying an assistive opening, closing, or holding force to the door 303. The refrigerated display unit 300 also includes an activity sensor 315 for detecting movement and/or obstructions between the door 303 and the refrigeration unit 301. In accordance with various embodiments, the refrigeration unit 301, the door 303, the handle 305, the hinge, the initiation sensor, and the augmentation drive can be, for example but not limited to, similar to refrigeration unit 201, door 203, handle 205, hinge 207, initiation sensor 213, and augmentation drive 209 as described above with reference to FIGS. 2A, 2B, and 4.

Activity sensor 315 can include, for example, one or more of a light curtain positioned between the second side 303*b* of the door and a second side 301*b* of a frame of the refrigeration unit 301 (e.g., as shown in FIG. 3), a light curtain positioned within the opening of the refrigerated display unit (e.g., from the second side 301*b* to a first side 301*a* of the frame of the refrigeration unit), a video camera; a proximity sensor, an infrared detector, or a motion sensor. As shown in FIG. 3, a light curtain sensor 307 includes a plurality of light emitters each emitting a beam of light to a paired one of a plurality of light receivers. When the one or more of the beams is interrupted by an item or a user, the sensor detects the interruption and conveys that an activity or obstruction is in process.

Figure 5:
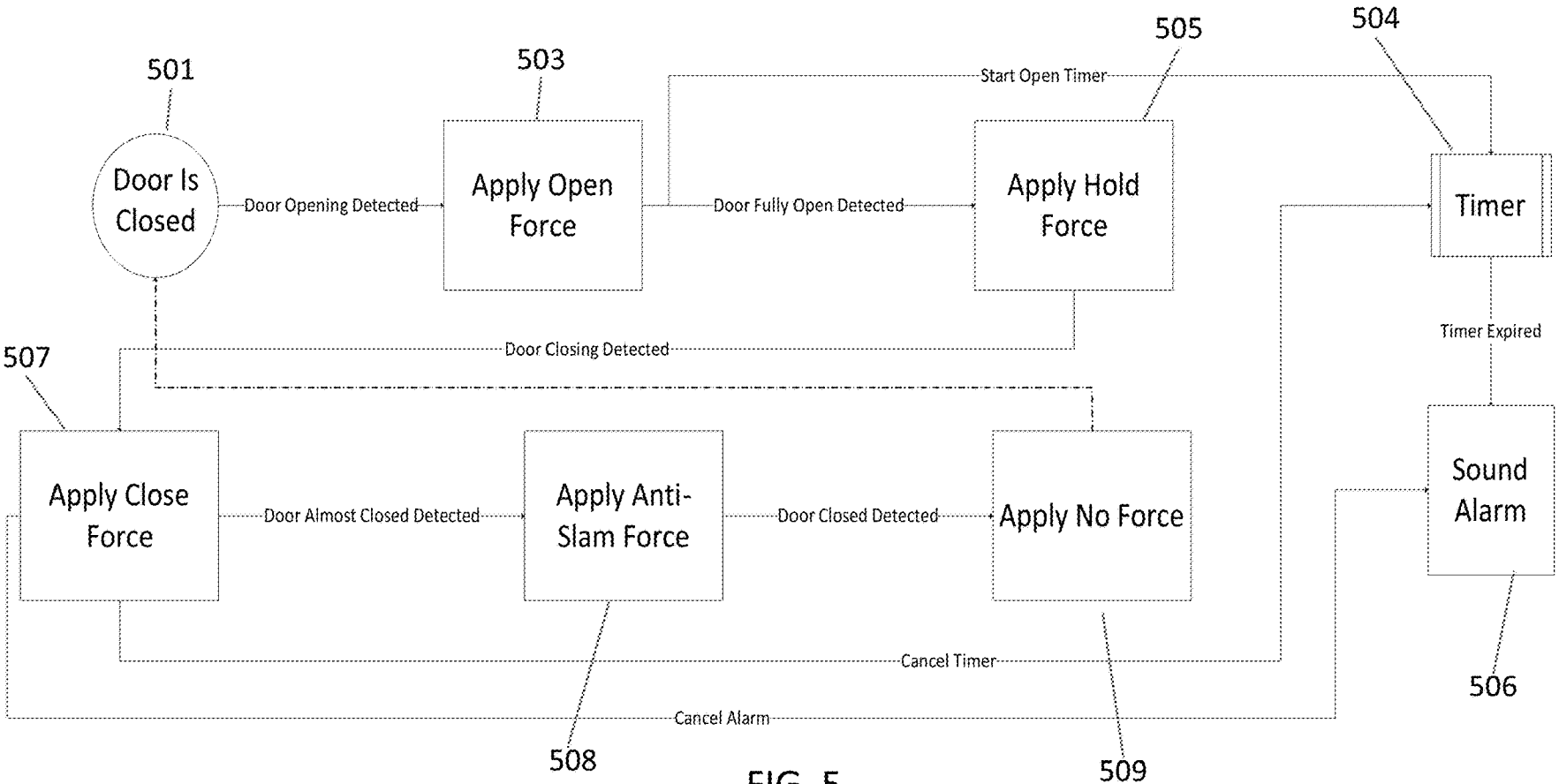
FIG. 5 is a functional flow diagram illustrating operation of an augmented refrigerated display unit in accordance with various embodiments

Referring now to FIG. 5, a functional flow diagram illustrates operation of an augmented refrigerated display unit (e.g., augmented refrigerated display units 200, 300) in accordance with various embodiments. The door (e.g., 203, 303) begins in a closed position 501. In response to detection of an application of a manual opening force to the door (e.g., by initiation sensor 213) an augmentation drive (e.g., augmentation drive 209) applies an assistive opening force 503 to the door. In response to detection of the door reaching an open position, the augmentation drive terminates the assistive opening force and applies a holding force 505 to maintain the open position of the door. In response to detection of an application of a manual closing force to the door, the augmentation drive terminates the holding force and applies an assistive closing force 507 to the door. In accordance with various embodiments, in response to a detection of the door reaching an almost closed or partially closed position of the door, the augmentation drive can terminate the closing force and apply an anti-slam force 508 for preventing the door from slamming and/or bouncing back open. It will be apparent in view of this disclosure that the anti-slam feature is optional and that, in accordance with other embodiments, the closing force can instead be terminated upon detection of a closed position of the door. In response to detection of the door reaching the closed position, the augmentation drive terminates all applied force 509.

In accordance with various embodiments, the augmented refrigerated display unit (e.g., augmented refrigerated display units 200, 300) can also include one or more timer functions 504 and/or alarms 506. In accordance with various embodiments, an open timer 504 can be initiated upon application of the assistive opening force 503 or upon application of the holding force 505. In accordance with various embodiments, a timer can be initiated in response to a detected cessation of activity (e.g., by activity sensor 315) of the augmented refrigerated display unit (e.g., augmented refrigerated display unit 300). In accordance with various embodiments, a timer can be initiated in response to a detected blockage of the door (e.g., by activity sensor 315) of the augmented refrigerated display unit (e.g., augmented refrigerated display unit 300).

Upon expiration of a predetermined period of time, in accordance with various embodiments, the timer can initiate termination of the holding force and/or application of the assistive closing force to the door. In accordance with various embodiments, upon expiration of a predetermined period of time, the timer can initiate an alarm in order to alert the user that the door has been open for an excessive period of time or to alert employees that a door may have been left open or is blocked by an object. In accordance with various embodiments, an additional timer can be initiated upon initiation of the alarm, wherein the holding force can be terminated and/or the assistive closing force can be applied to the door after the alarm has been activated for a prescribed period of time with no response from the user.

In describing exemplary embodiments, specific terminology is used for the sake of clarity. For purposes of description, each specific term is intended to at least include all technical and functional equivalents that operate in a similar manner to accomplish a similar purpose. Additionally, in some instances where a particular exemplary embodiment includes a plurality of system elements, device components or method steps, those elements, components or steps may be replaced with a single element, component or step. Likewise, a single element, component or step may be replaced with a plurality of elements, components or steps that serve the same purpose. Moreover, while exemplary embodiments have been shown and described with references to particular embodiments thereof, those of ordinary skill in the art will understand that various substitutions and alterations in form and detail may be made therein without departing from the scope of the invention. Further still, other aspects, functions and advantages are also within the scope of the invention.

Exemplary flowcharts are provided herein for illustrative purposes and are non-limiting examples of methods. One of ordinary skill in the art will recognize that exemplary methods may include more or fewer steps than those illustrated in the exemplary flowcharts, and that the steps in the exemplary flowcharts may be performed in a different order than the order shown in the illustrative flowcharts.

What is claimed is:

1. A refrigerated display unit comprising:

a door being hingedly attached to the refrigerated display unit at a first side of the door;

an activity sensor configured to detect movement of the door with respect to the refrigerated display unit;

an augmentation drive operatively connected to a hinge of the door for applying an assistive force to the door; and an initiation sensor configured to detect an application of a manual force to the door, wherein, in a closed position of the door, the augmentation drive is configured to apply an assistive opening force to the door in response to a detection by the initiation sensor of application of the manual force to open the door, wherein the augmentation drive is configured to terminate application of the assistive opening force and apply a holding force that maintains an open position of the door in response to a detection of the door reaching an open position, wherein, in the open position of the door, the augmentation drive is configured to terminate the holding force and apply an assistive closing force to the door in response to a detection by the initiation sensor of application of the manual force to close the door, and wherein the augmentation drive is configured to terminate application of the assistive closing force and apply an anti-slam force in response to the activity sensor detecting the door reaching a partially closed position.

2. The refrigerated display unit of claim 1, wherein the augmentation drive is at least one of a DC induction motor, a stepper motor, a servo, or a linear actuator.

3. The refrigerated display unit of claim 1, wherein the augmentation drive is operatively connected to the hinge of the door by at least one of a direct drive, an indirect drive, a chain drive, a transmission drive, or a rack and pinion.

4. The refrigerated display unit of claim 1, wherein the initiation sensor includes at least one of a motion detector, a closed switch, a pressure sensor, or a current detector in windings of the augmentation drive.

5. The refrigerated display unit of claim 1, wherein the activity sensor is configured to detect at least one of a user activity or an obstruction preventing closure of the door.

6. The refrigerated display unit of claim 5, further comprising a timer configured to be initiated in response to a cessation of user activity detected by the activity sensor, the timer terminating upon expiration of a predetermined period of time.

7. The refrigerated display unit of claim 6, further comprising an alarm configured to activate in response to termination of the timer.

8. The refrigerated display unit of claim 7, further comprising a second timer configured to be initiated in response to activation of the alarm, the second timer terminating upon expiration of a second predetermined period of time, wherein the augmentation drive is configured to apply the assistive closing force in response to termination of the second timer.

9. The refrigerated display unit of claim 6, wherein the augmentation drive is configured to apply the assistive closing force in response to termination of the timer.

10. The refrigerated display unit of claim 5, wherein the activity sensor is at least one of a light curtain positioned between a second side of the door and a frame of the refrigerated display unit, a light curtain positioned within an opening of the refrigerated display unit, a video camera; a proximity sensor, an infrared detector, or a motion sensor.

11. The refrigerated display unit of claim 5, further comprising a timer configured to be initiated in response to detection by the activity sensor of an obstruction preventing closure of the door, the timer terminating upon expiration of a predetermined period of time.

12. The refrigerated display unit of claim 11, further comprising an alarm configured to activate in response to termination of the timer.

13. The refrigerated display unit of claim 1, further comprising a timer configured to be initiated in response to at least one of application of the assistive opening force or application of the holding force, the timer terminating upon expiration of a predetermined period of time.

14. The refrigerated display unit of claim 13, further comprising an alarm configured to activate in response to termination of the timer.

15. The refrigerated display unit of claim 14, further comprising a second timer configured to be initiated in response to activation of the alarm, the second timer terminating upon expiration of a second predetermined period of time, wherein the augmentation drive is configured to apply the assistive closing force in response to termination of the second timer.

16. The refrigerated display unit of claim 13, wherein the augmentation drive is configured to apply the assistive closing force in response to termination of the timer.

* * * * *